United States Patent [19]

Yrizarris

[11] Patent Number: 4,617,083

[45] Date of Patent: Oct. 14, 1986

[54] CARPET SEAMING TOOL

[76] Inventor: Raymond D. Yrizarris, 2931 E. 65th St., Long Beach, Calif. 90805

[21] Appl. No.: 762,926

[22] Filed: Aug. 6, 1985

[51] Int. Cl.[4] ..... B30B 3/00

[52] U.S. Cl. ..... 156/545; 156/304.7; 156/579

[58] Field of Search ..... 156/304.4, 304.7, 544, 156/545, 558, 502, 579, 367

[56] References Cited

U.S. PATENT DOCUMENTS

| | | | |
|---|---|---|---|
| D. 197,811 | 3/1964 | Relling | D54/13 |
| D. 241,704 | 10/1976 | Carter | D8/15 |
| 2,143,424 | 1/1939 | Schmidt | 219/25 |
| 2,430,920 | 11/1947 | Dodge | 219/19 |
| 2,906,847 | 9/1959 | Grevich | 219/21 |
| 3,287,542 | 11/1966 | Weitzner | 219/244 |
| 3,660,191 | 5/1972 | Shimota | 156/152 |
| 3,857,015 | 12/1974 | Clark | 219/244 |
| 4,439,904 | 4/1984 | Hoopengardner | 29/110.5 |

*Primary Examiner*—David Simmons

*Attorney, Agent, or Firm*—William L. Chapin

[57] ABSTRACT

A tool useful in carpet laying operations for producing seams in adjacent pieces of carpeting has an elongated upper box-like member with an open top and ends. A generally flat support plate within the box-like member is adapted to hold a heat iron used to melt adhesive on carpet seaming tape. An inverted, elongated channel member supports the upper box-like member, and also supports a number of transversely disposed horizontal axles. Each axle contains a plurality of concentrically mounted, parallel, freely rotatable discs spaced regularly along the length of the axle. Each disc has evenly spaced spikes projecting radially outward from the hub of the disc. Rolling the tool along a joint between adjacent pieces of carpeting intermingles the fibers of the two pieces of carpeting to minimize the visibility of the seam. Alternate embodiments of the tool include a cover and carrying handle fastenable over the box-like member, and a smooth base plate fastenable to the elongated channel member to cover the discs.

10 Claims, 6 Drawing Figures

CARPET SEAMING TOOL

BACKGROUND OF THE INVENTION

1. Field of the Invention

This invention relates to tools used in installing carpets. More particularly, the invention relates to tools used in carpet seaming operations in which adjacent pieces of carpet are cemented to a common backing surface with a hot-melt adhesive in a manner intended to minimize the visibility of the resulting seam.

2. Description of Background Art

In the course of installing or laying carpets on the floors of residences, commercial or industrial buildings, it is frequently necessary to use more than one piece of carpeting to cover the desired floor space. Therefore, it is often necessary to join adjacent pieces of carpeting. This usually results in seams of substantial length.

From an aesthetic standpoint, it is almost always desired to minimize the visibility of carpet seams. The ideal appearance sought is that of continuous expanse of carpeting covering the entire floor area, with any seams being invisible. To produce invisible seams in carpeting, there are a number of procedures well known in the art.

In one commonly used method of laying two adjacent pieces of carpet together to form an invisible seam between the abutting straight edges of the two pieces of carpet, the following steps are performed. First, the two pieces of carpet are cut to size, with the edges to be joined cut in a straight line. The two pieces of carpet are then positioned in place with their straight edges abutting. Next, a length of carpet seaming tape is laid underneath the cut edges. Half of the width of the tape extends under one piece of carpet, while the other half of the tape extends under the adjacent piece of carpet. The carpet seaming tape has a tear resistant, fabric-like back and is coated on its upper surface with a hot-melt adhesive.

With a length of carpet seaming tape in place under the entire length of the edges of the carpet segments to be joined, the edges of the carpet at one end of the joint are folded upwards and away from the joint, exposing the carpet seaming tape below. A heat iron with an elongated flat rectangular bottom approximately as wide as the carpet seaming tape is then placed on the upper surface of the tape and pushed along the tape in the direction of the seam, forward from the rear edges of the carpet segments. The heat flowing from the heat iron to the carpet seaming tape raises the temperature of the hot-melt adhesive sufficiently to make it semi-liquid. With the adhesive in that state, it readily adheres to materials such as carpeting. Thus, at this time, the edges of adjacent carpet segments which were initially folded up and away from the carpet seaming tape may be folded back down into place onto the tacky upper surface of the carpet seaming tape. A downward pressure is then placed on the upper surfaces of the edges of the carpet segments, forcing the lower surfaces of the segments into intimate contact with the semi-liquid adhesive on the upper surface of the carpet seaming tape. When the adhesive cools, a tight bond forms between the lower surfaces of the carpet segments and the carpet seaming tape, and therefore between the carpet segment edges.

As has been mentioned, a downward pressure must be exerted on the upper surfaces of carpeting to make it adhere tightly to the tacky hot-melt adhesive on the upper surface of carpet seaming tape, which underlies the edges of the carpet to be joined. A heavy implement with a flat, smooth bottom surface is useful for this purpose.

In some carpet seaming operations, it is desired to intermingle fibers from adjacent edges of carpet segments to conceal the seam line. For this purpose, a roller having a number of parallel discs each having a plurality of evenly spaced spikes projecting radially outward from the disc is often used. The spiked roller is rolled back and forth along a previously cemented seam, teasing or pulling up the ends of fibers from adjacent carpet edges and intermingling them across the seam. This helps to create the appearance of a continuous, seamless carpet.

In performing the steps of melting adhesive on the carpet seaming tape, applying a downward pressure to the carpet edges, and teasing the seam with a spiked roller, carpet installers using presently available equipment encounter a number of problems. In working his way along the length of the joint line to form a seam, the installer usually has to travel a distance of many feet. Therefore, each of the tools and implements required for the carpet seaming operation must be dragged along with him, since they cannot be placed in a position accessible from all points along the seam.

Also, the installer must be careful to place the heat iron which he has used to melt adhesive on the carpet seaming tape in a location where liquid adhesive will not flow onto the carpet, and where the iron will not cause burns.

The present invention was conceived of in an effort to alleviate some of the aforementioned problems experienced in the installation and seaming of carpets.

OBJECTS OF THE INVENTION

An object of the present invention is to provide a carpet seaming tool useful in forcing carpeting onto an adhesive coated backing surface.

Another object of the invention is to provide a tool which can provide a substantial downward pressure on carpeting to be cemented to a backing surface, while not requiring the installer to exert an excessive amount of force on the tool.

Another object of the invention is to provide a carpet installation tool which may be used to tease and intermingle fibers of adjacent carpet segments joined side by side.

Another object of the invention is to provide a carpet installation tool which may be used to provide a storage compartment for the safe storage and transportation of a hot heat iron.

Another object of the invention is to provide a carpet seaming tool in which the various implements used in the seaming operation are all readily accessible in a single portable unit.

Various other objects and advantages of the present invention, and its most novel features, will become apparent to those skilled in the art by reading the accompanying specifications and claims.

It is to be understood that although the invention disclosed herein is fully capable of achieving the objects and providing the advantages described, the description of the invention contained herein is merely illustrative of the preferred embodiments. Accordingly, I do not intend that the scope of my exclusive rights and privileges in the invention be limited to the details of the embodiments described. I do intend that reasonable equivalents, adaptations and modifications of the various embodiments and alternate forms of the present invention which are described herein be included within the scope of this invention as particularly pointed out by the appended claims.

SUMMARY OF THE INVENTION

Briefly stated, the present invention comprehends a tool for use in laying adjacent pieces of carpeting to form an elongated linear seam between abutting edges of the pieces of carpet. The carpet seaming tool according to the present invention includes an elongated box-like member with an open top and ends. An open, inverted U cross-section channel of substantially the same length as the box-like member is fastened to its under side. The front and rear side walls of the channel are approximately co-planar with the front and rear side walls of the box-like member. A plurality of parallel, horizontal axles disposed perpendicular to the channel front and rear side walls are secured thereto. A plurality of evenly spaced parallel discs each having evenly spaced spikes projecting radially outward from the hub of the disc are rotatably mounted on each axle. The spiked discs and supporting axle together form a spiked roller. The weight of the carpet seaming tool according to the present invention is sufficiently large to exert a substantial downward force on spikes contacting carpeting on which the tool is placed.

Preferably, an elongated, flat metal heat shield and support plate for a heat iron is mounted on and parallel to the upper surface of the bottom of the box-like member. The support plate is adapted to receive a heat iron having a flat, rectangular sole plate, and to hold the heat iron in place by means of spring clips which can engage the front and rear edges of the sole plate.

In a modified embodiment of the invention, the structure previously described includes an elongated cover shell having a plurality of fasteners which may be readily engaged or disengaged with complementary fasteners mounted on the front and rear sides of the box-like member. A carrying handle is centrally fastened to the upper surface of the cover shell. Thus, with the cover shell fastened to the box-like member, the interior of the box-like member, which may contain a heat iron, is covered and protected. Also, the handle provides a convenient means for carrying the tool.

In addition to the cover shell, the tool according to the present invention may include an elongated bottom shell which can be fastened over the spiked rollers on the bottom of the tool. The bottom shell includes fasteners which permit the shell to be easily installed on or removed from the tool.

The front and rear surfaces of the bottom shell of the tool curve gently upward from the bottom surface. Thus, with the bottom shell in place, the tool is suited to applying a reciprocating ironing motion on a carpet surface.

DETAILED DESCRIPTION OF THE INVENTION

Figure 1:
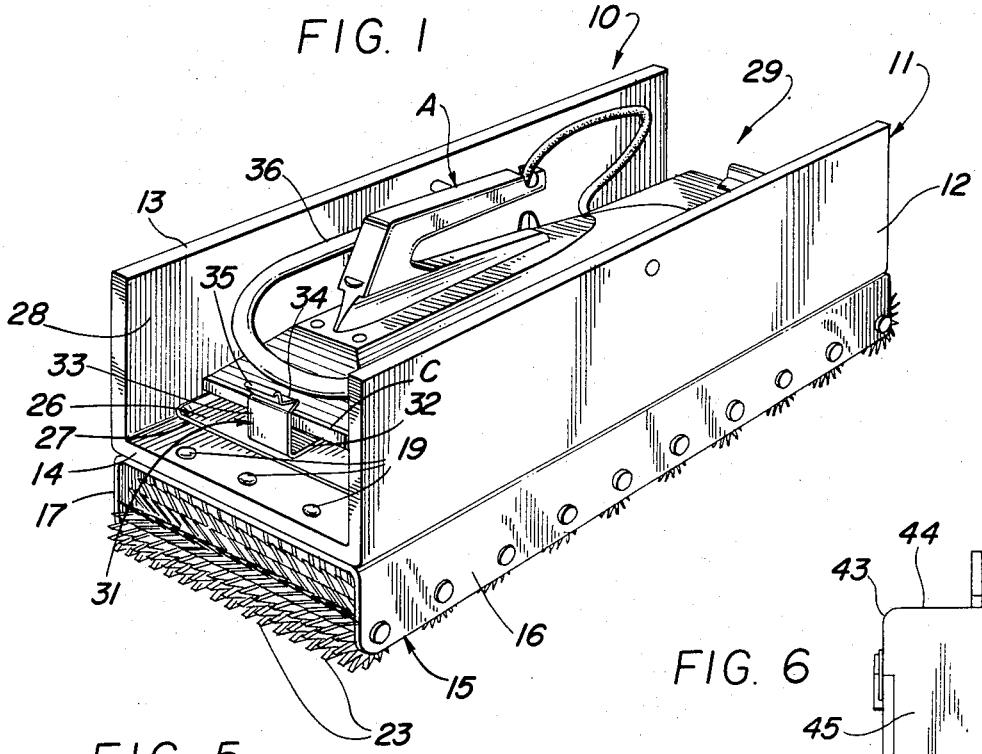
FIG. 1 is an upper perspective view of the carpet seaming tool according to the present invention.

Referring now to FIGS. 1 through 4, a carpet seaming tool 10 according to the present invention is shown. As may be seen best by referring to FIG. 1, the tool 10 includes an elongated upper box-like member 11. Box-like member 11 has a U-shaped transverse cross-sectional shape, with flat, rectangular, parallel front and rear walls 12 and 13, respectively, and an elongated, rectangular bottom wall 14 joined perpendicularly to the bottom edges of front and rear walls 12 and 13. Upper box-like member 11 is preferably fabricated by bending a flat blank of sheet metal.

Figure 2:
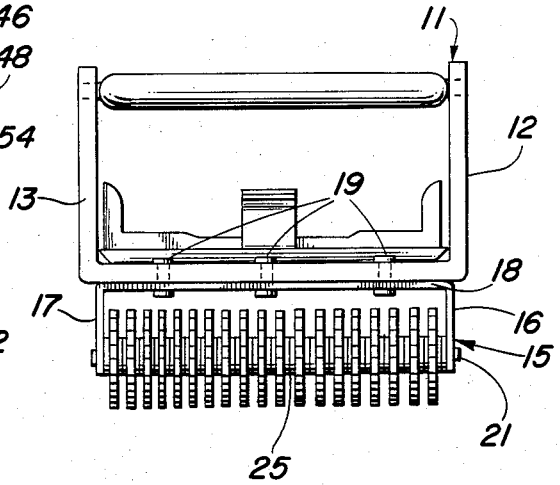
FIG. 2 is an end elevation view of the device of FIG. 1.
Figure 3:
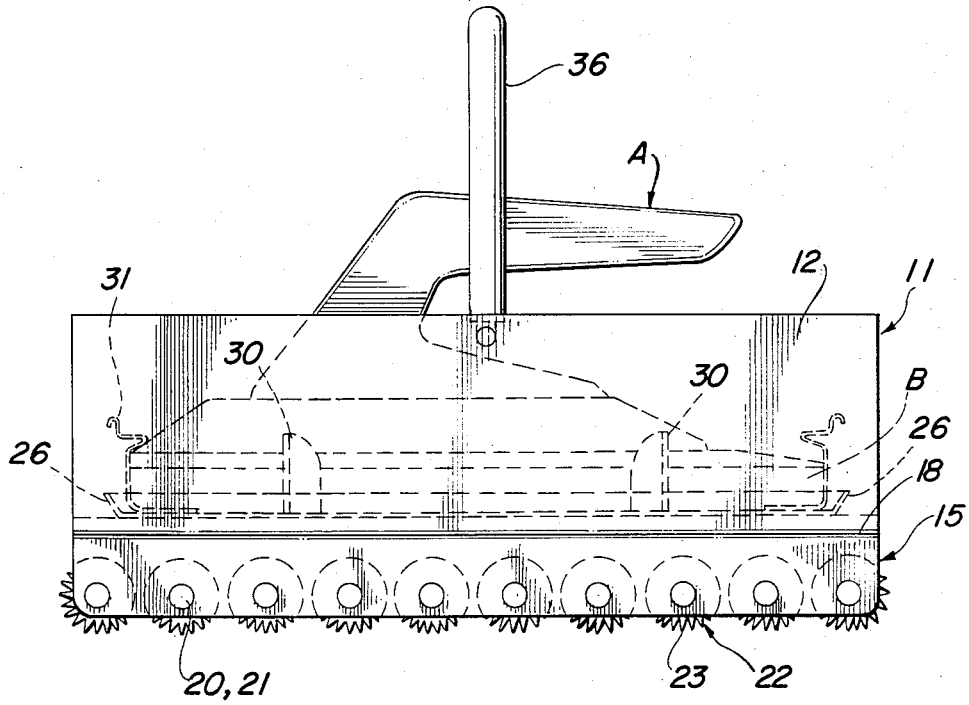
FIG. 3 is a front elevation view of the device of FIG. 1.

As may be seen best by referring to FIGS. 1, 2, and 3, a lower, inverted U cross-section channel section 15 similar in size and shape to upper box-like member 11 is fastened to the underside of upper member 11. Lower channel section 15 has flat rectangular front and rear walls 16 and 17 respectively, joined at right angles at their upper edges to front and rear edges of elongated rectangular bottom wall 18. Lower channel section 15 is preferably fabricated from a single piece of sheet metal. The upper surface of bottom wall 18 of lower channel section 15 is joined conformally to the lower surface of bottom wall 14 of upper box-like member 11 by rivets 19. As shown in FIG. 3, bottom wall 18 and bottom wall 14 are fastened with their respective long and short sides in congruent alignment. As may be seen best by referring to FIGS. 3 and 4, a plurality of circular cross-section, cylindrical axles 20 parallel to each other and parallel to bottom wall 18 of lower channel section 15 are disposed perpendicularly between front wall 16 and rear wall 17 of the lower channel section. Axles 20 are preferably fabricated from a durable metal such as steel, and are held to front wall 16 and rear wall 17 by nuts 21.

Figure 4:
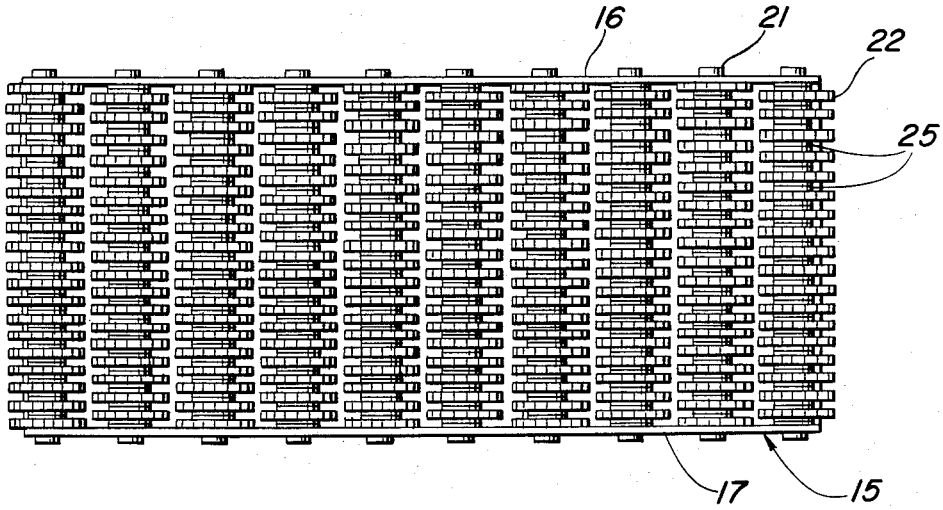
FIG. 4 is a bottom plan view of the device of FIG. 1.

As shown in FIGS. 2, 3, and 4, a plurality of circular discs 22 having radially outward projecting spikes 23 are rotatably mounted on each axle 20. The spikes 23 have a generally triangular cross sectional shape transverse to the rotational axis of disc 22, and project outward from a central hub section 24 at evenly spaced polar angles. Spiked discs 22 are preferably fabricated as stampings from heavy gauge steel plate.

As may be seen best by referring to FIG. 2, spiked discs 22 are mounted at even longitudinal distances along the length of axle 20 spanning the distance between front wall 16 and rear wall 17 of lower channel section 15. The axial spacing between discs 22 on axle 20 is maintained by spacing washers 25 mounted over axle 20 on either side of each disc 22.

As may be seen best by referring to FIGS. 1 and 3, an elongated, flat rectangular heat shield 26 having upwardly curved edges 27 is mounted on the upper surface of bottom wall 14 of upper box-like member 11. Heat shield 26 is symmetrically disposed between the inner facing surfaces of front wall 12 and rear wall 13 of box-like member 11, with its long axis parallel to the front and rear walls. Also, heat shield 26 is symmetrically disposed between front opening 28 and rear opening 29 of upper box-like member 11.

Approximately halfway between the transverse center line of heat shield 26 and either longitudinal end of the shield, vertical rectangular support plates 30 are mounted to the upper surface of the heat shield. Support plates 30, positioned at the front and rear of heat shield 26, are perpendicularly disposed between the long edges of the heat shield, and fastened to its upper surface. Support plates 30 are preferably fabricated from medium gauge, heat resistant metal.

Near the front and rear edges of heat shield 26, L-shaped retainer clips 31 are fastened to the upper surface of the heat shield with their bases 32 perpendicularly disposed towards the transverse center plane of the heat shield, and their legs 33 extending perpendicularly upwards from the plane of heat shield 26. The upper end of each leg 33 of spring clip 31 has a serpentine series of bends, bending inward to form ridge 34 and then outward and downward to form curved finger grip 35. Spring clips 31 are fabricated of spring steel, and the spacing between ridges 34 of the spring clip adapts the spring clip to snap over the front and rear edges of the sole plate B of heat iron A.

As shown in FIG. 3, heat iron A may thus be locked in position between ridges 34 of spring clips 31, with the bottom surface of sole plate B of the heat iron resting on the upper edges of support plates 30. With iron A locked in place, U-shaped handle bail 36, which is pivotably mounted between the upper, inner facing walls 12 and 13 of apparatus 10, may be pivoted upward to a vertical position where the handle 36 may be easily grasped for carrying the apparatus, along with the contained heat iron A.

With heat iron A secured in carpet seaming tool 10, both implements may be easily carried to and from job sites, using handle 36. At a carpet installation site, heat iron A can be plugged in to an electrical outlet, causing iron A to heat up. During the warm-up period, iron A may remain locked in position in apparatus 10. When it is desired to use heat iron A, handle 36 may be pivoted forward as shown in FIG. 1, allowing the iron to be lifted backwards and upwards away from the apparatus.

After heat iron A has been used to melt adhesive on carpet seaming tape placed underneath adjacent carpet segments, tool 10 may be rolled back and forth along the seam. Spiked discs 22, forced down on the carpet surface by hand pressure and by the force of gravity acting upon the substantial weight of the apparatus, efficiently tease carpet fibers and tend to intertwine fibers of adjacent carpet segments in a criss-cross fashion across the seam. Thus, the apparatus 10 provides an effective means of minimizing the visibility of the seam.

To provide additional force useful in pressing spiked discs 22 down upon the carpet segments, weights may be incorporated into apparatus 10. Additionally or alternatively, heat iron A may be placed in position on support plates 30 of apparatus 10. In this position installed carpeting and floor surfaces are protected from the possibility of being damaged by contacting semi-liquid adhesive adhering to sole plate B of heat iron A. Moreover, the weight and low center of gravity of the apparatus 10 helps to insure that it will not tip over, spilling liquid adhesive which may have dropped from sole plate B of heat iron A onto the surface of heat shield 26. Any liquid adhesive which does fall on the heat shield is prevented from spilling off the heat shield by the upward curved edges 27 of the heat shield.

Figure 6:
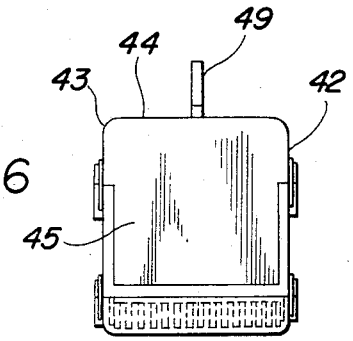
FIG. 6 is an end elevation view of the device of FIG. 5.
Figure 5:
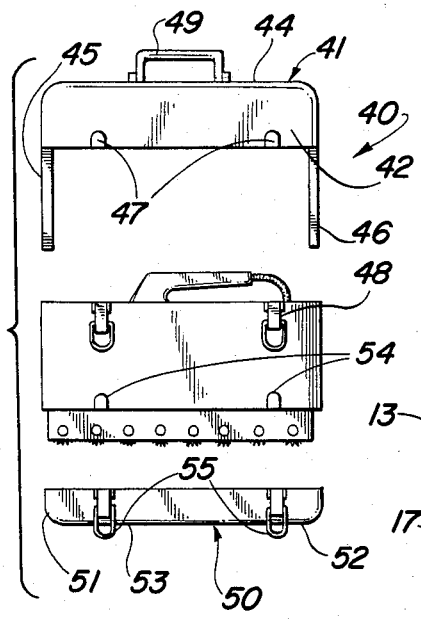
FIG. 5 is a front elevation view of an alternate embodiment of the device of FIG. 1.

FIGS. 5 and 6 illustrate an alternate embodiment 40 of the apparatus shown in FIGS. 1 through 4. Alternate embodiment 40 includes an elongated, hollow cover shell 41 having elongated, parallel rectangular front and side walls 42 and 43 respectively. The upper edges of front wall 42 and rear wall 43 are joined perpendicularly to the long front and rear edges, respectively, of top panel 44 of cover shell 41.

Extending downward from the left and right edges, respectively of top panel 44 of cover shell 41 are left and right side panels 45 and 46, respectively. Side panels 45 and 46 are rectangular and extend some distance below the lower edges of front wall 42 and rear wall 43 of cover shell 41. As shown in FIG. 6, side panels 45 and 46 are adapted to closing the openings in either end of upper box-like member 11 of apparatus 40 when cover shell 41 is down in place on top of box-like member 11. Cover shell 41 is preferably fabricated from a single piece of medium gauge steel plate.

As may be seen best by referring to FIG. 5, luggage-type fastener posts 47 are mounted near the lower edges of the front and rear walls 42 and 43 of cover shell 41. One fastener 47 is mounted near the left side of front wall 42, and a second fastener 47 is mounted in a parallel position on the outer surface of back wall 43. A third fastener 47 is mounted near the right side of front wall 42, and a fourth fastener is mounted in a parallel position on the outer surface of back wall 43.

As shown in FIG. 5, four fastener mechanisms 48, engageable with fastener posts 47, are mounted on front wall 12 of box-like member 11, near its upper edge, and on rear wall 13 of box-like member 11, near its upper edge. Fastener mechanisms 48 are mounted in positions which will place each of them adjacent to a fastener post 47, with cover shell 41 in place on box-like member 11. Thus, with cover shell 41 in place on box-like member 11, fastener mechanisms 48 may be snapped into engagement with fastener posts 47, thereby securing cover shell 41 to box-like member 11. Carrying handle 49 is fastened to top panel 44 of cover shell 41, permitting cover shell and attached apparatus to be carried as a unit.

Preferably, alternate embodiment 40 also includes a detachable bottom cap 50. As may be seen best by referring to FIG. 5, bottom cap 50 is a generally trough-shaped, elongated rectangular cross-section structure having left and right edge walls 51 and 52 that curve smoothly upward from bottom wall 53 of cap 50. Bottom cap 50 is preferably fabricated by die casting from aluminum or other light metal. Bottom cap 50 includes fastener posts 54 analogous in form, location and function to fastener posts 47 on cover shell 41, previously described. Fastener mechanisms 55 engageable with fastener posts 54 are mounted on front wall 16 and rear wall 17 of lower channel section 15 and function analogously to fastener mechanisms 48, previously described. Thus, with bottom cap 50 in place beneath lower channel section 15, fastener mechanism 55 may be snapped into engagement with fastener posts 54, thereby securing bottom cap 50 to lower channel section 15. In this position, apparatus 40 may be transported without the possibility of damage occurring to spiked discs 22, or of injury or damage being caused by spiked discs 22.

In addition to covering spiked discs 22, bottom cap 50 provides additional capability to alternate embodiment 40 of the carpet seaming tool according to the present invention. Specifically, bottom cap 50 provides a flat, smooth rigid elongated structure with gently curved edges needed for certain cold "ironing" operations associated with the installation of carpets.

What is claimed is:

1. A tool for installing carpeting comprising:

(a) an elongated trough-like enclosure member having an elongated rectangular base of substantially uniform, U-shaped, transverse cross-sectional shape, elongated rectangular front and rear walls disposed perpendicularly upwards from the front and rear long edges, respectively of said base, and rectangular side openings, (b) an elongated channel section of substantially uniform, inverted U-shaped, transverse cross-sectional shape having an elongated rectangular base of substantially the same size and shape as said enclosure member base, and elongated front and rear walls disposed perpendicularly downwards from the front and rear long edges, respectively, of said channel section, said channel section being fastened to said enclosure member base with the upper surface of said channel section in adjacent, parallel, concentric alignment with the lower surface of said enclosure base, (c) a plurality of elongated cylindrical axles parallel to each other and to said channel base disposed underneath said channel section perpendicularly to said front and rear walls of said channel section and fastened thereto, and (d) a plurality of circular discs, each said disc having spike-like members projecting radially outwards from the hub of said disc at regular polar angles, said discs being rotatably mounted on each said axle at regular intervals spanning substantially the distance between said front and rear walls of said channel section.

2. The apparatus of claim 1 further comprising an elongated, substantially flat rectangular mounting plate mounted parallel to the base of said trough-like enclosure member, said mounting plate being symmetrically disposed between said front and rear walls and said open ends of said trough-like enclosure and said mounting plate being adapted to support the rectangular base of a heat iron.

3. The apparatus of claim 2 further comprising a handle bail pivotably fastened at opposite ends of said handle bail to said apparatus, whereby said handle bail may be pivoted downward from a vertical position adapted to supporting said apparatus while carrying it to a downward position permitting placing and removing said heat iron on said mounting plate.

4. The apparatus of claim 2 further comprising a plurality of flat, rectangular metal strips disposed with their long axes perpendicular to the long edges of said mounting plate, said metal strips symmetrically spanning a substantial portion of the distance between said long edges of said mounting plate with the planes of said strips perpendicular to the plane of said support plate, said strips being adapted to support said base of said heat iron above said mounting plate.

5. The apparatus of claim 4 further comprising spring clips fastened to the front and rear short edges, respectively, of said support plate, said spring clips being adapted to lockingly engage the front and rear edges respectively, of the sole plate of a heat iron.

6. The apparatus of claim 1 further comprising an elongated hollow cover shell adapted to fit downward over said trough-like enclosure member, said cover shell having:

(a) a flat, elongated rectangular top panel, (b) flat elongated rectangular front and rear side panels depending perpendicularly downward from the front and rear edges, respectively, of said top panel, (c) flat rectangular side panels depending perpendicularly downward from the side edges, respectively, of said top panel, said side panels extending beyond the lower edges of said front and rear panels and adapted to cover said rectangular side openings in said trough-like enclosure member, and (d) means for fastening said cover shell above and to said trough-like enclosure member with the bottom edges of said cover shell front and rear side panels in close parallel alignment with the upper surfaces of the front and rear walls, respectively, of said front and rear walls of said trough-like enclosure member.

7. The apparatus of claim 6 further comprising an elongated, substantially flat rectangular mounting plate mounted parallel to the base of said trough-like enclosure member, said mounting plate being symmetrically disposed between said front and rear walls and said open ends of said trough-like enclosure, and said mounting plate being adapted to support the rectangular base of a heat iron.

8. The apparatus of claim 7 further comprising a plurality of flat, rectangular metal strips disposed with their long axes perpendicular to the long edges of said mounting plate, said metal strips symmetrically spanning a substantial portion of the distance between said long edges of said mounting plate with the planes of said strips perpendicular to the plane of said support plate, said strips being adapted to support said base of said heat iron above said mounting plate.

9. The apparatus of claim 8 further comprising a spring clip fastened to the front and rear short edges, respectively, of said support plate, said spring clips being adapted to lockingly engage the front and rear edges, respectively, of the sole plate of a heat iron.

10. The apparatus of claim 6 further comprising an elongated trough-like base plate having:

(a) flat, relatively long parallel front and rear walls, (b) a smooth, flat base disposed perpendicularly to the bottom edges of said front and rear walls, said base curving smoothly upward at either end of said base plate to form relatively short parallel end walls, the hollow interior of said base plate being adapted to fit over said plurality of said circular discs mounted on the bottom of said channel section, and (c) means for removably fastening said base plate to said apparatus with said base plate parallel to and substantially enclosing said circular discs and the lower portion of said channel section.

* * * * *